United States Patent [19]

Carstedt

[11] 4,104,983

[45] Aug. 8, 1978

[54] PULSATING GLUE HEAD FOR FOLDING MACHINES

[76] Inventor: Howard B. Carstedt, Rte. 1, Box 208, Loretto, Minn. 55357

[21] Appl. No.: 715,443

[22] Filed: Aug. 18, 1976

[51] Int. Cl.[2] ..... B05C 5/02

[52] U.S. Cl. ..... 118/2; 118/32; 118/411; 156/357; 156/443; 156/578

[58] Field of Search ..... 118/2, 3, 410, 411, 118/32; 222/525; 156/227, 357, 443, 578; 270/68 R

[56] References Cited

U.S. PATENT DOCUMENTS

| | | | |
|---|---|---|---|
| 2,670,102 | 2/1954 | Mangano | 222/525 X |
| 3,420,208 | 1/1969 | Guthrie | 118/411 X |
| 3,429,482 | 2/1969 | Nord et al. | 222/525 X |
| 3,661,679 | 5/1972 | Law | 118/411 X |
| 3,747,917 | 7/1973 | Roda | 270/68 R |
| 3,947,175 | 3/1976 | Melcher | 222/525 X |

*Primary Examiner*—John P. McIntosh

*Attorney, Agent, or Firm*—Williamson, Bains, Moore & Hansen

[57] ABSTRACT

Apparatus for automatically spot gluing printed sheets on a folding machine. The apparatus comprises an applicator head, an internally defined cylinder interconnected with a source of fluid pressure, and a reciprocally displaceable piston disposed within the cylinder for selectively engaging to be glued. The piston includes a glue output orifice adapted to contact a printed sheet to be folded and glued in a folded condition. The orifice is in fluid flow communication with a glue input source. In a single action embodiment the apparatus includes a return spring for resetting the piston after each spot gluing operation, and in an alternative double action embodiment fluid pressure is utilized to automatically reset the piston at a preselected instant.

The spot gluer is located immediately in front of a stop bar which serves to stop moving sheets and buckle them between folding rollers.

5 Claims, 9 Drawing Figures

PULSATING GLUE HEAD FOR FOLDING MACHINES

BACKGROUND OF THE INVENTION

This invention relates generally to apparatus for automatically gluing objects. More particularly, the instant invention is related to apparatus for automatically gluing an object in response to predetermined movement of same.

In the prior art a variety of apparatus has been employed to automatically glue strips of paper or other objects during automated handling of same. For example, spray-type gluers have been associated with printing machines in the prior art. One disadvantage of machines of this character is that usually too large an area is sprayed by the gluer often resulting in contamination of the conveying apparatus utilized to move the glued objects through the mechanized process. Often spray gluing apparatus becomes jammed as deposits of glue form and dry on the output orifice. Often conventional spray heads are too big or cumbersome to fit between the rollers employed in conventional folding machines and are usually too big to be employed in conjunction with apparatus for printing small magazine or newspaper inserts.

Another type of prior art gluing apparatus simply wipes on glue in the form of a strip during the conveying of an object to be glued through a mechanized process. One problem with this technique is that glue often leaks down the front edge of inserts, and when the papers or other objects are subsequently stacked, the inserts will stick together. A prior art glue dispenser of this nature usually includes a head having a downwardly pointing wiping orifice which contacts the slidably moving object to be glued. Wiping-type glue dispensers of this nature are controlled by a remotely located shut-off valve above the apparatus which can be manipulated to control the flow of glue. However, a problem with apparatus of this nature is that glue often continues to drip or run out of the applicator, eventually jamming the feed machinery. When the glue leaks onto the fold rollers of a folding machine the machine must be stopped so that rollers can be cleaned appropriately, obviously slowing down production. In order to overcome the latter problem, it has been known in the fold rolling art to provide a circumferential groove in the fold rollers to avoid mechanical contact with the strip of glue applied to the conveyed objects. The strip will normally line up with the roller groove to prevent contact, but deviation from ordinary roller alignment present problems. Of course grooved rollers must be changed where not suited for other jobs with which the rolling machine may be employed.

SUMMARY OF THE INVENTION

The instant invention comprises apparatus for spot gluing objects or articles conveyed through an automated process.

In a preferred form of the invention the apparatus comprises a glue applicator head in which an internally defined cylinder in fluid flow communication with a source of fluid pressure receives a reciprocally displaceable applicator piston. The piston is responsive to fluid pressure to briefly contact an object to be glued, thereby "spot gluing" the object to provide a precisely formed and controlled glue area. The piston is preferably provided with an elongated tubular shank portion defining a glue output orifice and passageway and a circumferential, glue receptive groove defined in the shank. The groove is in fluid flow communication with the output orifice and passageway. When the piston is in the inoperative rest position, the groove will be substantially sealed by gaskets associated therewith to prevent the outputting of glue. However, when the piston is actuated the glue receptive groove will be substantially aligned with an adjacent glue input port thereby allowing pressurized glue to be forced through the output orifice to spot glue the object contacted by the shank. In this manner precise outputting of glue is accomplished while at the same time preventing glue leakage or spillage.

In one form of the invention the glue outputting piston is provided with a coiled, internally disposed spring for automatically returning it to the reset position after a gluing operation. In an alternative embodiment of this invention, the cylinder head is provided with a second pressure input line for automatically forcing the piston to the reset position in response to fluid pressure. In each form of the invention a solenoid valve system may be employed to actuate the piston, and means responsive to the position of articles to be glued are provided for actuating the apparatus.

Thus, a broad object of this invention is to provide a system for spot gluing an object or article.

Another object of this invention is to provide means for precisely and accurately applying glue to objects or articles moving through an automated process. It is a feature of this invention that only spots of glue are applied to objects, rather than the strips of glue characteristic of the prior art.

Still another object of this invention is to provide an automatic, pulsating glue dispensing system which employs a reciprocal piston for precisely outputting glue.

Yet another object of this invention is to provide a glue dispensing system which is characterized by precise control of glue outputted thereby and which avoids the leakage or spillage often associated with the prior art. An important feature of this invention is that glue is forced through the applicator piston only when the piston is displaced in the glue outputting position.

Another object of this invention is to provide a system of the character described for speeding up the process of gluing in an automated system. An important characteristic of one embodiment of this invention is that pneumatic or hydraulic pressure lines may be employed to quickly move the glue outputting piston between glue dispensing and reset positions.

Another object of this invention is to provide a glue dispensing head of the character described which can be quickly and economically installed on existing machinery such as fold rolling machines or the like.

Yet another object of this invention is to provide a spot gluing system of the character described which is responsive to the position of objects to be glued.

A still further object of this invention is to provide a folding machine with spot gluing apparatus of the character described wherein the spot glue applicator is located between fold rollers and a stop bar and is actuated by a sensor located just in front of the stop bar in the path of movement of printed sheets.

These and other objects and advantages of this invention, along with features of novelty appurtenant thereto, will appear or become apparent in the course of the following detailed description.

BRIEF DESCRIPTION OF THE DRAWINGS

In the following drawings, which form a part of the specification and are to be construed in conjunction therewith, and in which like reference numerals have been employed throughout to indicate like parts in the various views.

DETAILED DESCRIPTION OF THE DRAWINGS

Figure 1:
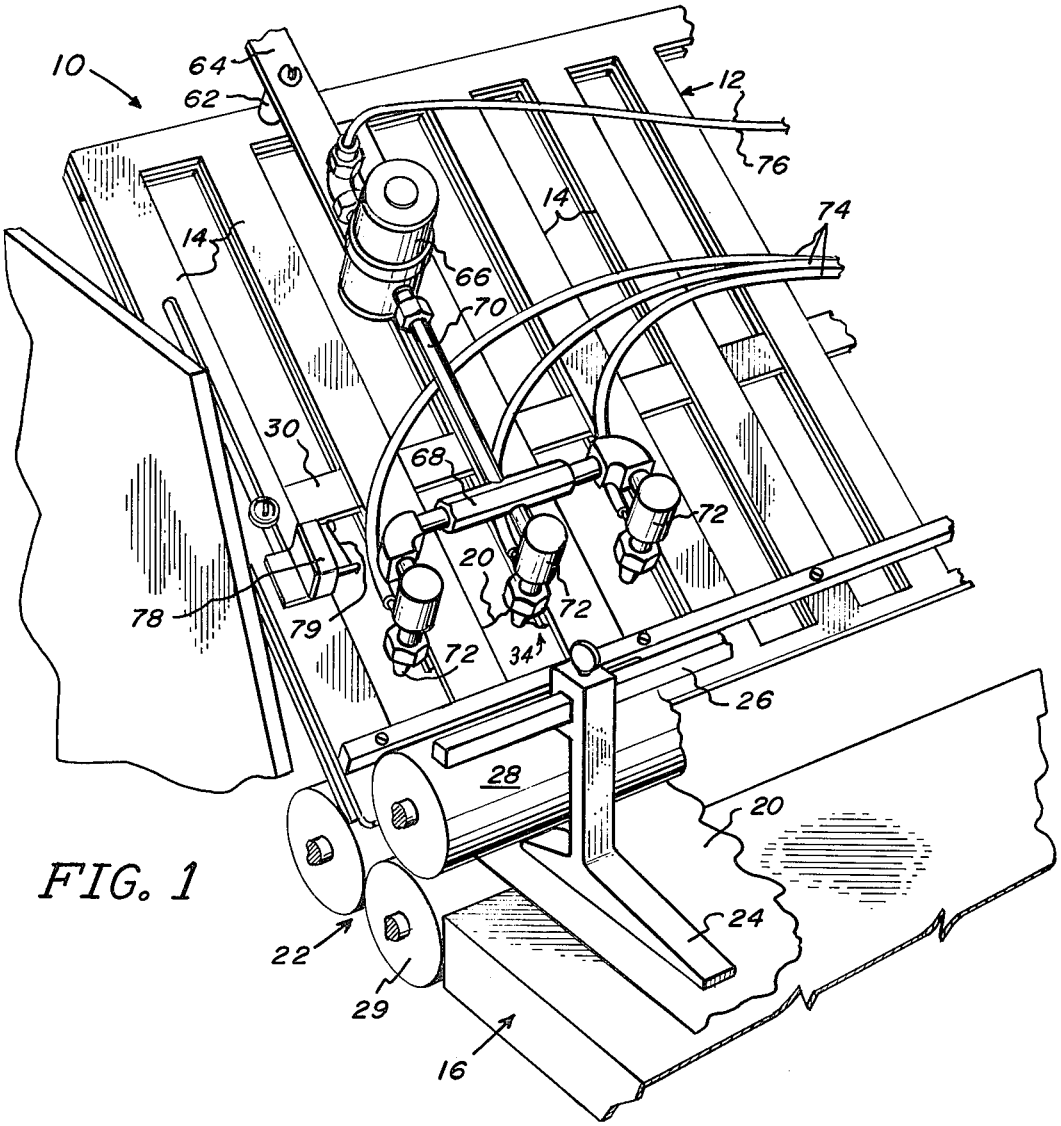
FIG. 1 is an abbreviated perspective view of a feed roller machine equipped with spot gluing apparatus constructed in accordance with the teachings of this invention.

Referring initially to FIG. 1 there is illustrated a folding machine on which glue dispensing apparatus constructed in accordance with the teachings of this invention has been operatively mounted. The feed roller machine 10 comprises a generally upwardly inclined, planar folding plate 12 comprised of a plurality of spaced apart ribs 14 which are inclined with respect to a lower, horizontally disposed, stationary feeder table 16. A sheet of paper (or similar article) 20 is being drawn into the roller assembly 22 between feeder table 16 and a sheet guide 24. The guide 24 comprises a generally inverted T-shaped structure which is clamped at a desired position upwardly from feed table 16 to a transverse support frame member 26. Sheet 20 is initially drawn into the apparatus when it contacts a first roller 28, which urges it inwardly into the mouth of the apparatus until an edge of the paper contacts a stop bar 30 disposed transversely along holding plate 12. As will be described in more detail subsequently, a spot gluing assembly 34 is rigidly mounted with respect to folding plate 12 at a preselected, critical distance above the edge of the sheet 20 progressing through the apparatus.

Figure 2:
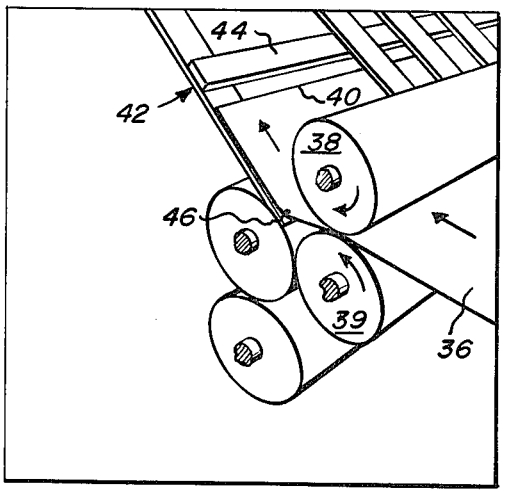
FIG. 2 is an abbreviated, diagrammatic view illustrating the basic operation of a folding machine.
Figure 3:
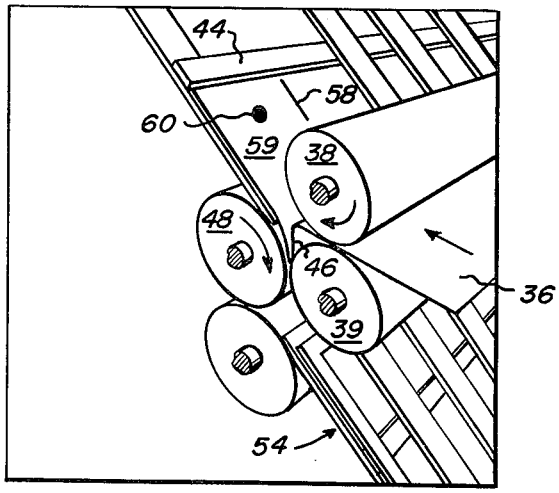
FIGS. 3 through 5 are views similar to FIG. 2 showing later steps in the folding process.
Figure 4:
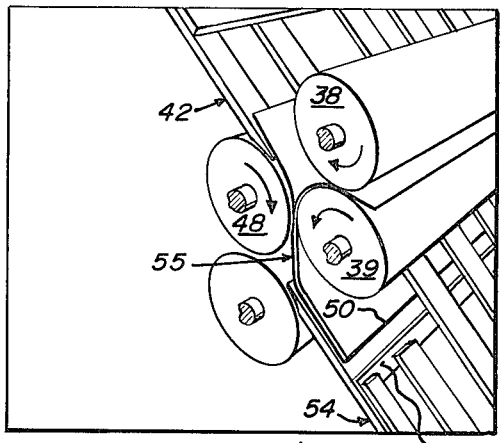
Figure 5:
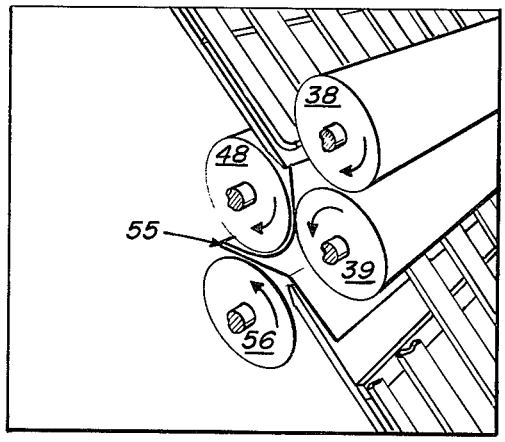

Referring now to FIGS. 2 through 5 the basic operation of a folding machine is illustrated. In FIG. 2 a sheet of paper 36 (or similar article to be folded and glued) has been drawn into the folding apparatus between roller wheels 38 and 39. The leading edge 40 of sheet 36 will be propelled along folding plate 42 into contact with a transverse fold plate gauge bar 44 which stops linear travel of the sheet 36 and causes the formation of a buckle or fold 46. As illustrated in FIG. 3, fold 46 will then be drawn between rollers 48 and 39 until the leading edge 50 (FIG. 4) of the fold contacts a similar fold plate gauge 52 associated with lower fold plate 54. Contact of edge 50 with fold plate gauge 52 will facilitate the formation of a subsequent buckle 55, which will be pulled between rollers 48 and 56 thereby forming another fold. It will be apparent to those skilled in the art that where folding machines of this general type are employed, additional rollers and associated apparatus will be employed to generate the desired number of folding operations.

Before the buckle is drawn into the rollers to form the desired fold, a surface of the paper to be folded is preferably glued so that the article or paper will be maintained in the desired folded position. Referring now to FIG. 3, there is illustrated an elongated, glue strip 58 applied to an inner surface 59 of the paper 36. Glue strip 58 is characteristic of prior art, wiping-type glue applicator techniques, wherein a glue head frictionally contacts surface 59 of the paper as it is drawn into the rolling wheels 48 and 39. It will be apparent to those skilled in the art that one problem with gluing of this type is that the glue strip 58 is so long that it very likely may contact the outer circumferential surface of drum roller 38, thereby contaminating same and causing it to stick to subsequently introduced paper. On the other hand, there is also illustrated in FIG. 3 a glue spot 60 of the type applied by applicant's spot gluing apparatus to be hereafter described. It will be apparent to those skilled in the art that the limited dimensions of glue spot 60 prevent contact with roller 38, although facilitating proper gluing of the paper during the folding operation already discussed.

In FIG. 1 one form of applicant's invention is illustrated attached to the folding machine 10. Applicant's gluing apparatus 34 is supported a predetermined distance above the surface of the paper 20 being introduced into the apparatus by a spacer 62 which offsets a support frame member 64. The apparatus comprises a pressure control valve 66, preferably in the form of a solenoid valve, which is attached to a pressure manifold 68 through an elongated, rigid tubular pipe 70. Manifold 68 includes a plurality of spot gluing applicator heads 72, each of which is in fluid flow communication with pressure supplied through the manifold 68. Each applicator head is also connected to a conventional glue supply through hoses 74. The solenoid valve 66 is in fluid flow communication with an external pressure supply through a line 76. Although it is contemplated that a pneumatic system shall be employed, it will be recognized by those skilled in the art that any form of fluid pressure actuation such as a hydraulic system will be equally advantageous. There is also illustrated a trigger means 78 which is secured to the folding plate 12 near the folding plate gauge 30. Trigger means 78 activates solenoid 66 and is preferably in the form of a microswitch, which has a small trigger portion 79 thereof disposed near stop gauge 30 to contact the leading edge of the paper being drawn through the apparatus to thereby initiate gluing in response to a predetermined movement or position of the paper being conveyed through the folding apparatus.

Figure 6:
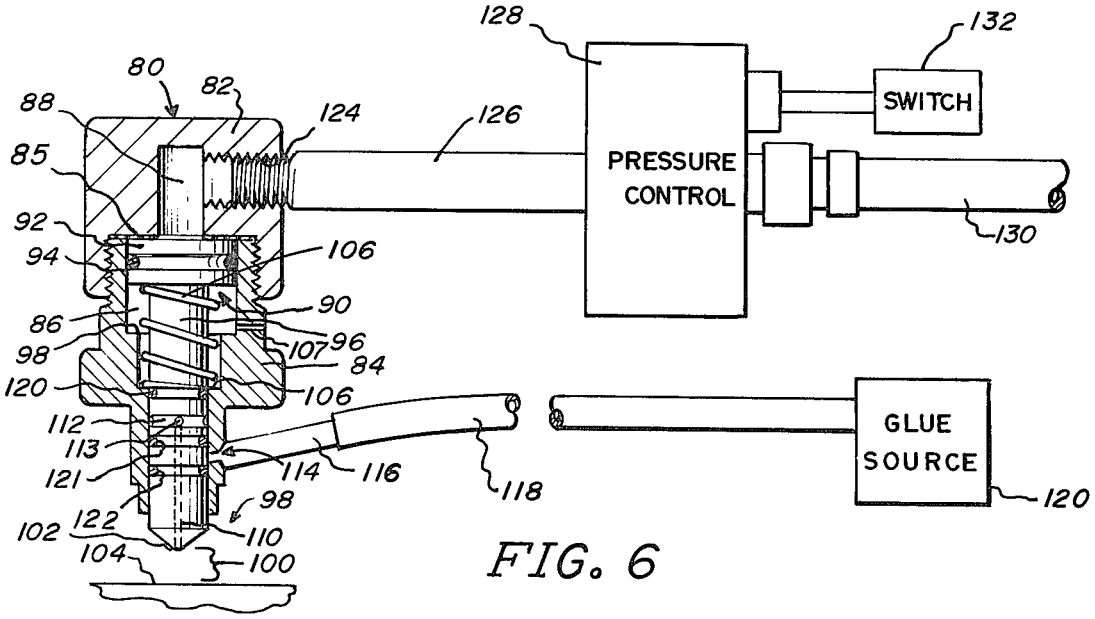
FIG. 6 is a block diagram of gluing apparatus constructed in accordance with the teachings of this invention, showing a single action glue applicator head in section.
Figure 7:
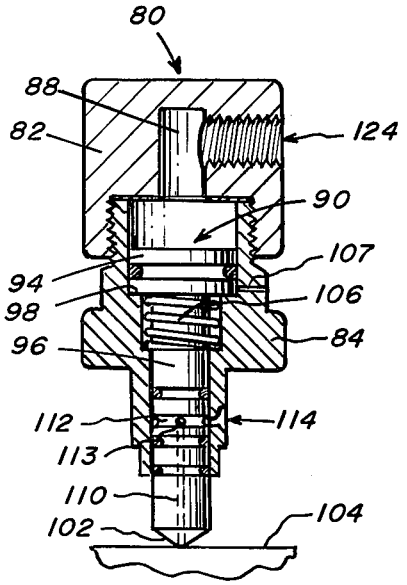
FIG. 7 is a sectional view of the applicator head in FIG. 6 disposed in the operative, spot gluing position.

In FIGS. 6 and 7 a single action spot gluing applicator head 80 is illustrated in detail. Head 80 preferably comprises an upper, threaded fitting 82 which matingly receives a lower threaded fitting 84. Fittings 82 and 84 are preferably of brass construction. A circumferential gasket 85 provides an airtight seal between the fittings. An elongated, generally cylindrical cylinder 86 is defined within head fitting 84, and is in fluid flow communication with passageway 88 in the upper fitting 82. A piston assembly 90 is reciprocally disposed with cylinder 86 for movement between a sealed rest position illustrated in FIG. 6 and the operative glue dispensing position illustrated in FIG. 7. Piston assembly 90 comprises a piston 92 of a diameter substantially equal to the internal diameter of cylinder 86, and includes a sealing ring 94 seated in a circumferential groove defined therein for sealing the piston in a normal manner. The piston assembly also includes an elongated shank portion 96 which is attached to piston 92 and which exits from the lower end 98 of head portion 84 to contact the paper (or other article or object) to be glued.

A shoulder 98 formed in cylinder 86 limits piston travel by contacting the underside of piston 92. Importantly, the distance 100 between the glue output orifice 102 in the piston shank and an object 104 to be glued should be adjusted by the operator to approximately equal the distance between the underside of piston 92 (when in the rest position) and cylinder shoulder 98. A preferably coiled spring 106 is wound about shank 96 and is disposed between the underside of piston 92 and a second lower recessed shoulder portion 106. After piston 92 has been deflected downwardly, as illustrated in FIG. 7, spring 106 will automatically reset the piston for a subsequent gluing operation. Passageway 107 vents cylinder pressure prior to piston resetting.

Glue is outputted through the piston assembly through an elongated glue output passageway 110 which extends vertically upwardly through the center of shank 96 and which is in fluid flow communication with a circumferential, glue receptive groove 112 provided in shank 96. To this effect an orifice 113 drilled through the shank intercommunicates groove 112 and passageway 110. When the piston is deflected downwardly, groove 112 will be positioned interiorly adjacent a glue input port 114 provided at the lower end of head cap portion 84. A suitable liquid glue is delivered to orifice 114 through a preferably brass fitting 116 and a glue line 118 which is in fluid flow communication with a conventional source of glue 120. As best seen in FIG. 7, when the piston is deplunged within the cylinder it will be apparent that glue entering orifice 114 under pressure will be outputted through passageway 110, passing through groove 112 via orifice 113. However, when the piston is in the sealed rest position illustrated in FIG. 6 (i.e., after the piston is reset), glue will be prevented from dripping out of the apparatus by a plurality of spaced apart sealing rings 120, 121 and 122. Ring 122 will of course prevent glue from dripping downwardly from orifice 114 when the piston is reset. Sealing ring 121 will prevent the passage of glue past the glue receptive groove 112, while sealing ring 120 will provide an effective seal between cylinder 86 and groove 112.

Pressure, preferably pneumatic, is delivered to applicator head 80 through a threaded fitting 124 received by head cap portion 82. Fitting 124 is in fluid flow communication through a line 126 with a conventional source of pneumatic pressure 128. It is contemplated that pressure source 128 will be in the form of a conventional air solenoid valve which receives pressure via a line 130 from a conventional air pressure source (not shown). Solenoid 128 is actuated by a switch 132 which will be mechanically positioned in order to trip the solenoid in response to a predetermined movement of an object to be glued. For example, the microswitch 78 (equivalent to switch 132) illustrated in FIG. 1 has been fastened to the apparatus near the stop gauge 30 so that switch element 79 which projects towards the stop gauge will contact the leading edge of paper to suitably actuate the apparatus. A type 8345 ASCO midget valve available from the Automatic Switch Company, Florham Park, New Jersey 07932, will suitably perform the task of selectively delivering air to line 126 in response to the switch 132.

Figure 8:
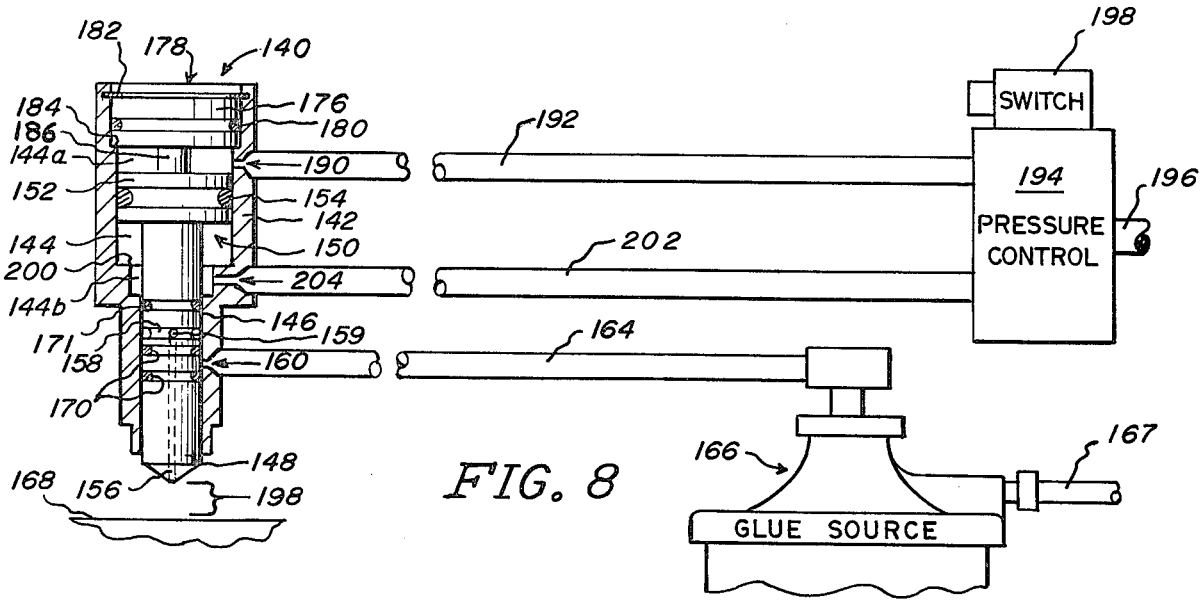
FIG. 8 is a block diagram of a preferred embodiment of glue applicator apparatus constructed in accordance with the teachings of this invention, and showing a double action glue applicator head in section.
Figure 9:
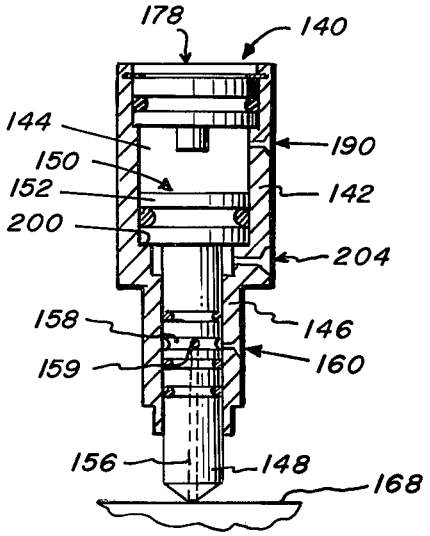
FIG. 9 is a sectional view of the applicator head in FIG. 8 disposed in the operative, spot gluing position.

Referring now to FIGS. 8 and 9, there is seen an alternative embodiment of this invention comprising a double action applicator head 140. Head 140 preferably comprises an elongated, generally cylindrical housing 142 which includes an internally defined cylinder 144 and a somewhat lesser diameter portion 146 thereof. An elongated shank portion 148 of the piston assembly 150 disposed within cylinder 144 penetrates cylinder portion 146. Assembly 150 includes a piston 152 which is reciprocally movable within cylinder 144, being sealed within same by a circumferential sealing ring 154. Shank 148 is integrally attached to piston 152 and extends downwardly through the housing 142 to the exterior of the head. Extending centrally through the lower portion of shank 148 is an elongated glue output passageway 156 which is in fluid flow communication with a glue receptive groove 158 provided in shank 148 via a passageway 159. As best seen in FIG. 9, when piston 152 is depressed or actuated, the glue receptive groove 158 will be internally positioned adjacent a glue input orifice 160 provided in housing 146, and which is in fluid flow communication via a line 164 with a conventional pressurized glue source 166. Thus, when the piston is actuated glue will be forced through line 164, orifice 160, groove 158, and outputted through passageway 156 which will be in contact with an article 168, comprising a sheet of paper or the like. Shank 148 includes a pair of spaced apart sealing rings 170 which prevent leakage of glue, and an upper sealing ring 171 which provides a seal between cylinder 144 and groove 158.

Housing 142 is sealed by an upper cap 176 which is fitted within the upper orifice 178 in housing 142 and which is in turn sealed by a circumferential sealing ring 180. A circumferential clip 182 maintains cap 176 in position against an upper shoulder 184. A shank portion 186 descending downwardly from cap 176 contacts piston 152 to maintain it in correct position when in the reset or rest position. The upper cylinder volume **144*a* is in fluid flow communication with a source of pressure through an orifice 190 which communicates with a line 192 in fluid flow communication with pressure source 194. Source 194 preferably comprises a four-way solenoid valve, such as an ASCO type 8345, four-way midget valve, available from Automatic Switch Company, Florham Park, New Jersey. Valve 194 is preferably connected to a conventional source of pressure through conventional pressure line 196, and valve 194 is suitably actuated in response to predetermined movement of an object to be glued by switch 198. Switch 198 may be a conventional electrical switch such as a microswitch or the like and it may include electronic transistor circuitry as will be recognized by those skilled in the art. Switch 198 should also be located appropriately as discussed earlier in conjunction with equivalent switch 78 in FIG. 1**.

When the switch 198 senses the movement of an object to be glued, the solenoid 194 will be actuated thereby pressuring line 192 to depress piston 152. When this occurs glue receptive groove 158 will be positioned adjacent glue input orifice 160 so that glue will be forced through passageway 156 and thereby spot glue the object 168. It should be noted that the head 140 should be positioned a preselected distance 198 (FIG. 8) away from object 168. Distance 198 is of course equal to the distance between the lower piston surface and the deflection limiting shoulder 200.

A second pressure input line 202 supplies pressure from pressure control valve 194 to a cylinder orifice 204 in order to selectively reset the piston assembly 150 by forcing it upwardly into contact with shank 186. It will be observed in FIG. 9 that when the piston assembly is in the operative glue dispensing position, pressure subsequently supplied to lower cylinder volume 144b will drive piston 152 upwardly, thereby resetting the head after each gluing operation. The preferably four-way configuration of valve 194 facilitates selective pressurization of 192 and 202 as will be recognized by those skilled in the art.

Where a large area of paper or other article to be glued is necessary, a plurality of applicator heads may be connected to a manifold and operated in parallel, as illustrated generally in FIG. 1, wherein a manifold 68 operates a plurality of applicator heads 72. In the latter case the glue input lines will be paralleled, and the pressure input lines will be paralleled. It has been found by applicant that the double action glue applicator 140 functions significantly quicker than the single action head 80. Thus, where relatively slow processing apparatus is employed the less expensive applicator head 80 will be suitable. However, where large numbers of articles or objects to be glued must be handled very quickly then the faster applicator head 140 has been found desirable. When associated with a folding machine 10 either one of the applicator heads 80 or 140 have been found to provide very dependable and reliable results.

From the foregoing, it will be seen that this invention is one well adapted to obtain all the ends and objects herein set forth, together with other advantages which are obvious and which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. In a machine for folding printed sheets comprising sheet feeding means, at least one pair of fold rollers, and travel stop means located downstream of said pair of fold rollers in the direction of sheet movement for stopping moving sheets and initiating buckling and folding of printed sheets, the improvement comprising:

a spot glue dispenser located in the space between said pair of fold rollers and said stop means adjacent to said fold rollers, said dispenser comprising cylinder means secured to said folding machine at a vertically offset location from the path of movement of printed sheets, a piston within said cylinder means reciprocally displaceable from a rest position to an extended, glue dispensing position, and a glue output orifice on said piston normally spaced from moving sheets and movably positioned to contact a sheet and spot glue same when said piston is in said extended position; and sensing means positioned immediately adjacent to said stop means on the upstream side thereof with respect to the direction of sheet movement, in position to be actuated by movement of the leading edge of a moving sheet, said sensing means being operable to initiate movement of said piston to said glue dispensing position, whereby said dispenser is actuated to apply a spot of glue to a sheet at the moment a sheet is stopped against said stop means.

2. Apparatus as defined in claim 1 wherein:

said cylinder means has an input port for receiving glue and is connected to a source of pressurized fluid by a flow control valve, said piston being moveable to said glue dispensing position by said pressurized fluid; and said sensing means is operably associated with said flow control valve for opening same to direct pressurized fluid into said cylinder means in response to movement of a sheet against said stop means.

3. Apparatus as defined in claim 2 wherein:

said sensing means comprises a micro-switch having a trigger member disposed immediately in front of said stop means in the path of sheet movement, and said flow control valve is a solenoid valve.

4. Apparatus as defined in claim 2 wherein: said piston comprises:

an elongated tubular shank portion having a groove around its periphery adapted to be interiorly positioned adjacent said cylinder means glue input port for receiving glue when said piston is disposed in said operative position;

a flow passage extending longitudinally within said tubular shank portion defining a glue output orifice in fluid flow communication with said groove, said tubular shank being displaced exteriorly of said cylinder means when said piston is in said operative position, thereby positioning said glue output orifice to contact and spot glue a sheet; and gasket means for preventing the passage of glue between said groove and said cylinder glue input port when said piston is disposed in said rest position; and means for returning said piston to said rest position after a gluing operation.

5. Apparatus as defined in claim 4 wherein: said cylinder means is connected to said flow control valve by a first fluid pressure input line for initiating spot gluing by moving said piston to said glue dispensing position, and a second fluid pressure input line for resetting said piston after a gluing operation by returning it to said rest position from said operative glue dispensing position.

* * * * *